US009857032B2

(12) United States Patent
Li et al.

(10) Patent No.: US 9,857,032 B2
(45) Date of Patent: Jan. 2, 2018

(54) LED LIGHTING DEVICE AND MANUFACTURING METHOD THEREOF

(71) Applicant: OSRAM GmbH, Munich (DE)

(72) Inventors: Aiai Li, Shenzhen Guangdong (CN); Tingming Liu, Shenzhen Guangdong (CN); Yusheng Ming, Shenzhen Guangdong (CN); Shengmei Zheng, Shenzhen Guangdong (CN)

(73) Assignee: Ledvance GmbH (DE)

( * ) Notice: Subject to any disclaimer, the term of this patent is extended or adjusted under 35 U.S.C. 154(b) by 0 days.

(21) Appl. No.: 14/360,632

(22) PCT Filed: Sep. 27, 2012

(86) PCT No.: PCT/EP2012/069017
§ 371 (c)(1),
(2) Date: May 26, 2014

(87) PCT Pub. No.: WO2013/079242
PCT Pub. Date: Jun. 6, 2013

(65) Prior Publication Data

US 2014/0321123 A1 Oct. 30, 2014

(30) Foreign Application Priority Data

Nov. 29, 2011 (CN) ..... 2011 1 0386724

(51) Int. Cl.
*F21K 99/00* (2016.01)
*F21K 9/00* (2016.01)
(Continued)

(52) U.S. Cl.
CPC ..... *F21K 9/30* (2013.01); *F21K 9/00* (2013.01); *F21K 9/90* (2013.01); *F21V 19/005* (2013.01);
(Continued)

(58) Field of Classification Search
CPC ..... F21K 9/00
See application file for complete search history.

(56) References Cited

U.S. PATENT DOCUMENTS 7,267,459 B2 * 9/2007 Matheson ..... 362/362
7,905,632 B2 * 3/2011 Dobler et al. ..... 362/294
(Continued)

FOREIGN PATENT DOCUMENTS

CN 201069075 Y 6/2008
CN 101356858 A 1/2009
(Continued)

OTHER PUBLICATIONS

International Search Report issued in the corresponding PCT application No. PCT/EP2012/069017, dated Dec. 19, 2012.
(Continued)

*Primary Examiner* — Sharon Payne
(74) *Attorney, Agent, or Firm* — Hayes Soloway PC

(57) ABSTRACT

A LED lighting device is disclosed, which includes a LED lighting source, a printed circuit board, a heat sink and a transparent cover. The LED lighting source is provided on the printed circuit board, and the cover is attached to the heat sink for protecting the LED lighting source and the printed circuit board. The LED lighting device further includes a rivet made of plastics, which is used to fix the printed circuit board to the heat sink.

8 Claims, 5 Drawing Sheets

(51) Int. Cl.

| | |
|---|---|
| ***F21K 9/90*** | (2016.01) |
| ***F21V 19/00*** | (2006.01) |
| *F21V 29/70* | (2015.01) |
| *F21Y 103/10* | (2016.01) |
| *F21Y 115/10* | (2016.01) |

(52) U.S. Cl.
CPC ..... *F21V 29/70* (2015.01); *F21Y 2103/10* (2016.08); *F21Y 2115/10* (2016.08); *Y10T 29/49956* (2015.01)

(56) References Cited

U.S. PATENT DOCUMENTS

| | | | | |
|---|---|---|---|---|
| 2007/0183156 | A1 | 8/2007 | Shan | |
| 2009/0091934 | A1* | 4/2009 | Lin | 362/294 |
| 2010/0019689 | A1 | 1/2010 | Shan | |
| 2011/0242814 | A1* | 10/2011 | Markle | F21V 29/004 362/294 |

FOREIGN PATENT DOCUMENTS

| | | | |
|---|---|---|---|
| CN | 101871627 | A | 10/2010 |
| CN | 102204412 | A | 9/2011 |
| EP | 1590831 | A2 | 11/2005 |
| WO | 2004070839 | A2 | 8/2004 |
| WO | 2010027823 | A1 | 3/2010 |

OTHER PUBLICATIONS

Chinese Office Action based on Application No. 201110386724.0 (7 Pages and 10 Pages of English translation) dated Aug. 26, 2015.

* cited by examiner

LED LIGHTING DEVICE AND MANUFACTURING METHOD THEREOF

RELATED APPLICATIONS

The present application is a national stage entry according to 35 U.S.C. §371 of PCT application No.: PCT/EP2012/069017 filed on Sep. 27, 2012, which claims priority from Chinese application No.: 201110386724.0 filed on Nov. 29, 2011, and is incorporated herein by reference in its entirety.

TECHNICAL FIELD

Various embodiments relate to a LED lighting device used in offices, shops or homes, and also a manufacturing method of the LED lighting device.

BACKGROUND

Currently, the LED-based T8/T5 tubes are emerging as a replacement for traditional fluorescent lamps which can be widely used in the application sites, such as offices, shops and homes. The LED lighting device of the prior art generally includes a LED aluminum based board/printed circuit board, a LED lighting source, a transparent cover or a scattering cover, a heat sink and a heat conducting medium (for example, a heat conducting silicon). The printed circuit board is fixed to the heat sink typically by a plurality of screws in order to obtain perfect heat conductivity between the printed circuit board and the heat sink. Since the distance between the electrical element and the circuit of the printed circuit board and the screws is restricted critically, the plurality of screws used on the circuit board can affect the routing design of the circuit seriously. In addition, the use of the plurality of screws results in additional difficulties for the manufacture and maintenance of the products.

In the prior art, another solution is to connect the printed circuit board to the heat sink by means of a type of adhesive heat conducting glue. But this is not practical, because the T8/T5 tubes are relatively longer, the adhesive glue may cause reliability problems due to the thermal expansion during using, for example, the potential separation or curving of the printed circuit board and the heat sink.

SUMMARY

Various embodiments provide a LED lighting device, which can resolve the problems presented in the related art. The LED lighting device of the present disclosure not only can guarantee a perfect heat transmission between the printed circuit board and the heat sink, but also can simplify the design of the printed circuit board and the complexity of manufacturing, which allow the designer not to consider more about the insulativity between the mounting hole of the printed circuit board and the circuit and the electronic element of the printed circuit board. Therefore, the producing efficiency of the LED lighting device is improved, and the manufacturing cost is reduced.

A LED lighting device according to the present disclosure includes a LED lighting source, a printed circuit board, a heat sink and a transparent cover. The LED lighting source is provided on the printed circuit board and the cover is attached to the heat sink for protecting the LED lighting source and the printed circuit board. The present disclosure is characterized in that the LED lighting device further includes a rivet made of plastics, which is used to fix the printed circuit board to the heat sink.

The LED lighting device according to the present disclosure further includes a heat conducting member and/or a heat conducting medium, which are/is provided between the printed circuit board and the heat sink and used to transmit the heat generated from the printed circuit board to the heat sink. The heat conducting member is, for example, a heat conducting space washer and the heat conducting medium is, for example, a heat conducting silicon.

In various embodiments, a plurality of the rivets are formed into one piece, which is integrally provided on the heat sink in the process of manufacturing the LED lighting device. The providing of the plurality of rivets as one piece can improve the mounting efficiency of the rivets greatly, therefore, improving the producing efficiency of the LED lighting device.

According to various embodiments, the rivet is formed integrally with the heat sink. Integrating the rivet and the heat sink into one piece can further improve the producing efficiency of the LED lighting device.

According to various embodiments, a free end of the rivet made of plastics is melted into different shapes as required, such as cone, cylinder or semisphere. This construction in the embodiment can meet various dimension and shape requirements of the internal structure of the LED lighting device; therefore, it is convenient to manufacture the lighting device.

According to various embodiments, a method for manufacturing a LED lighting device is also provided, which includes the steps of:

- providing a heat sink for the LED lighting device and a rivet made of plastics;
- inserting the rivet from the bottom of the heat sink into the mounting hole of the heat sink;
- providing a printed circuit board, and arranging it on the heat sink by bringing the rivet to pass through the printed circuit board;
- hot melting a free end of the rivet to fix the printed circuit board on the heat sink; and
- providing a transparent cover and attaching the transparent cover to the heat sink.

In the method for manufacturing the LED lighting device according to the present disclosure, before the step of arranging the printed circuit board on the heat sink, providing a heat conducting member and/or a heat conducting medium, for example, a heat conducting space washer and/or a heat conducting silicon, which transmit(s) the heat from the printed circuit board to the heat sink, and arranging the heat conducting member and/or the heat conducting medium between the printed circuit board and the heat sink.

In the method for manufacturing the LED lighting device according to the present disclosure, preferably, a plurality of the rivets made of plastics are formed into one piece, which is integrally provided on the heat sink in the process of manufacturing the LED lighting device.

In the method for manufacturing the LED lighting device according to the present disclosure, preferably, the rivet is formed integrally with the heat sink.

In the method for manufacturing the LED lighting device according to the present disclosure, a free end of the rivet made of plastics is melted into different shapes as required, such as cone, cylinder or semisphere.

BRIEF DESCRIPTION OF DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
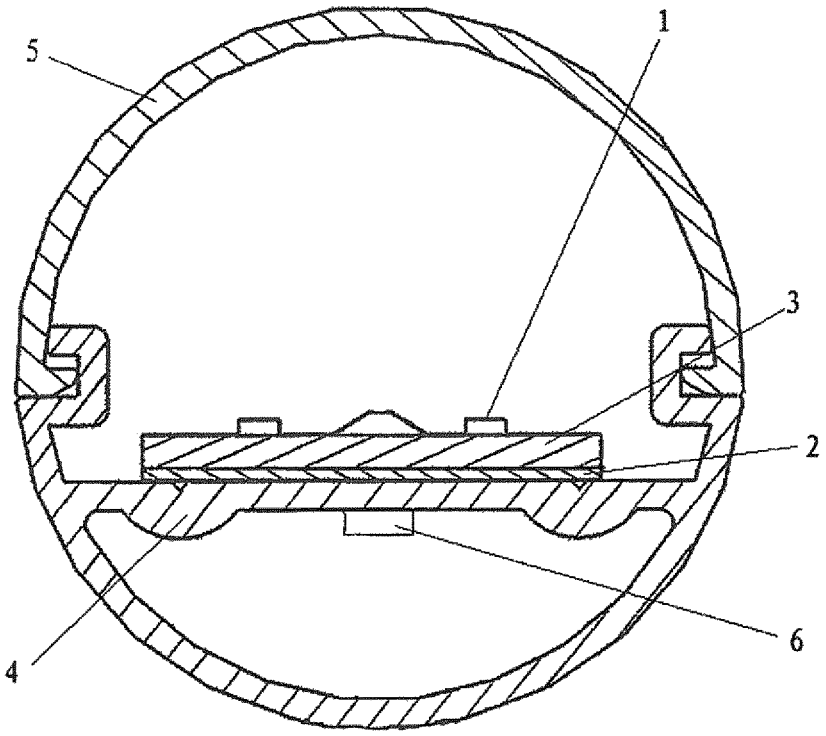
FIG. 1 is a cross section view showing a LED lighting device according to the present disclosure.

FIG. 1 is a cross section view showing a LED lighting device according to the present disclosure. The LED lighting device comprises a LED lighting source 1, a printed circuit board 3, a heat sink 4 and a transparent cover 5. The LED lighting source 1 is provided on the printed circuit board 3 which is arranged on the heat sink 4. The cover 5 is attached to the heat sink 4 for protecting the LED lighting source 1 and the printed circuit board 3. The LED lighting device further includes a rivet 6 made of plastics, which is used to fix the printed circuit board 3 to the heat sink 4. In addition, preferably, the LED lighting device further includes a heat conducting member 2 provided between the printed circuit board 3 and the heat sink 4, for transmitting the heat generated from the printed circuit board 3 to the heat sink 4. The heat conducting member 2 is, for example, a heat conducting space washer. Further, a heat conducting medium, for example, a heat conducting silicon, may also be arranged between the printed circuit board 3 and the heat sink 4. A heat conducting member and a heat conducting medium may be provided simultaneously between the printed circuit board 3 and the heat sink 4.

Since the printed circuit board 3 is fixed on the heat sink 4 by means of rivets 6 made of plastics, it is not necessary to consider more about the insulativity and the distance between the mounting hole of the printed circuit board and the electronic element and the circuit of the circuit board. The perfect heat transmission between the printed circuit board 3 and the heat sink 4 is guaranteed by the heat conducting member 2 and/or the heat conducting medium. Therefore, the construction reduces the difficulty of the design and the manufacture of the printed circuit board, and thus reducing the cost and improving the productivity.

Figure 2A:
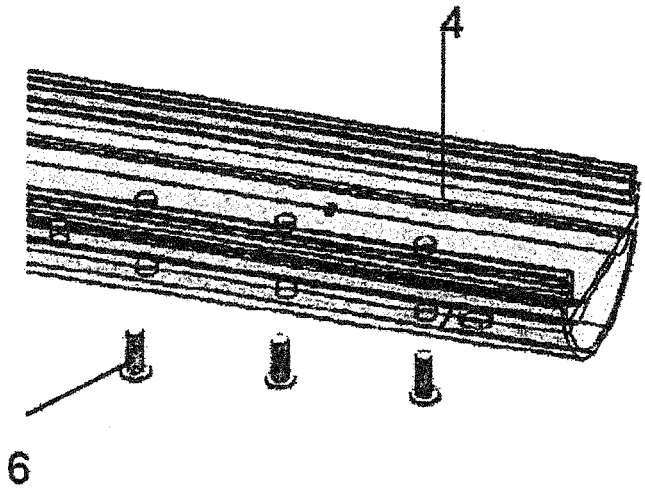
FIGS. 2A-2D are views showing the manufacturing process of the LED lighting device according to the present disclosure.
Figure 2B:
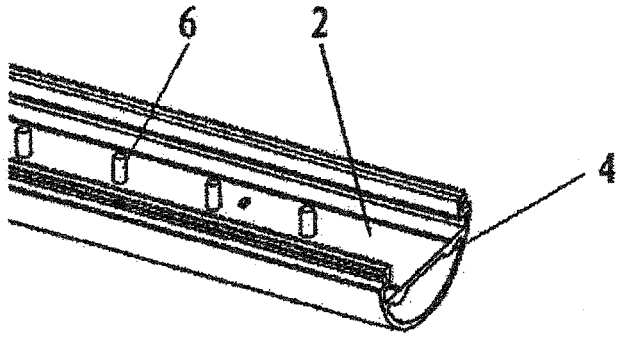
Figure 2C:
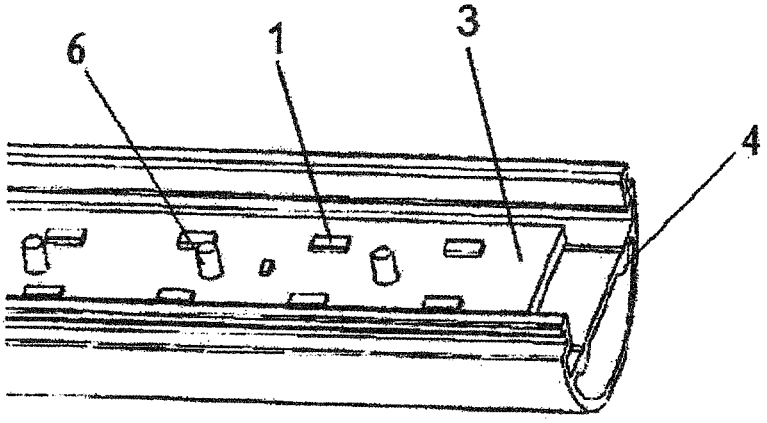
Figure 2D:
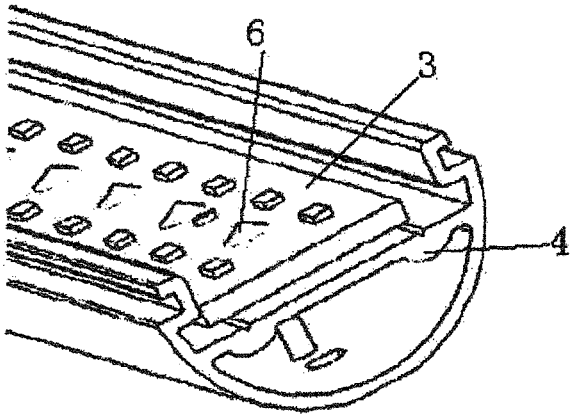

The process of manufacturing the LED lighting device according to the present disclosure is shown in FIGS. 2A-2D. Firstly, as shown in FIG. 2A, providing a heat sink 4 for the LED lighting device and a rivet 6 made of plastics; next, as shown in FIG. 2B, inserting the rivet 6 from the bottom of the heat sink 4 into the mounting hole of the heat sink 4; subsequently, as shown in FIG. 2C, providing a printed circuit board 3, and arranging it on the heat sink 4 by bringing the rivet 6 to pass through the printed circuit board 3; then, hot melting a free end of the rivet 6 to fix the printed circuit board 3 to the heat sink 4, as shown in FIG. 2D; and finally, providing a transparent cover 5 and attaching the transparent cover 5 to the heat sink 4, thus forming the LED lighting device as shown in FIG. 1.

Preferably, before the step of arranging the printed circuit board 3, through which the rivet 6 passes, on the heat sink 4, providing a heat conducting member 2 which transmits the heat from the printed circuit board 3 to the heat sink 4, and arranging the heat conducting member 2 between the printed circuit board 3 and the heat sink 4. The heat conducting member 2 is, for example, a heat conducting space washer. In addition, a heat conducting medium, for example, a heat conducting silicon, may also be arranged between the printed circuit board 3 and the heat sink 4. A heat conducting member and a heat conducting medium may be provided simultaneously between the printed circuit board 3 and the heat sink 4.

Figure 3A:
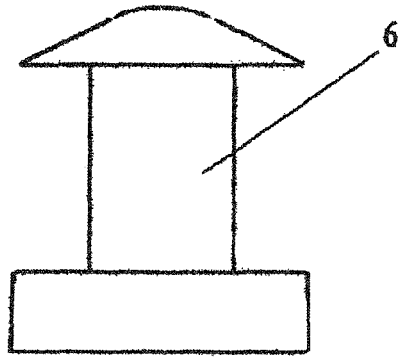
FIGS. 3A and 3B are views showing the state of a rivet made of plastics after melted according to the present disclosure.
Figure 3B:
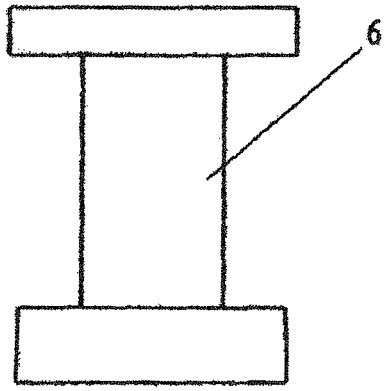

In the embodiment of the present disclosure, the free end of the rivet 6 may be melted into different shapes, for example, cone and cylinder as shown in FIGS. 3A and 3B respectively, according to the requirement of the internal structure of the LED lighting device. Of course, the free end of the rivet can be melted into other shapes, such as semisphere, as required.

Figure 4:
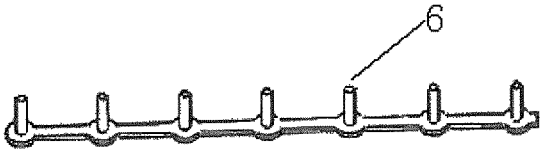
FIG. 4 is a view showing a plurality of rivets formed into one piece in another embodiment of the present disclosure.

In the embodiment of the present disclosure, a plurality of the rivets 6 made of plastics are mounted to the heat sink 4 respectively as separate components. In another embodiment of the present disclosure, a plurality of the rivets 6 made of plastics are formed into one piece as shown in FIG. 4. According to this embodiment of the present disclosure, a plurality of rivets 6 as one piece are mounted integrally to the heat sink 4 in once mounting, and it eliminates the step of mounting for several times. Thus, the production efficiency is improved.

Figure 5:
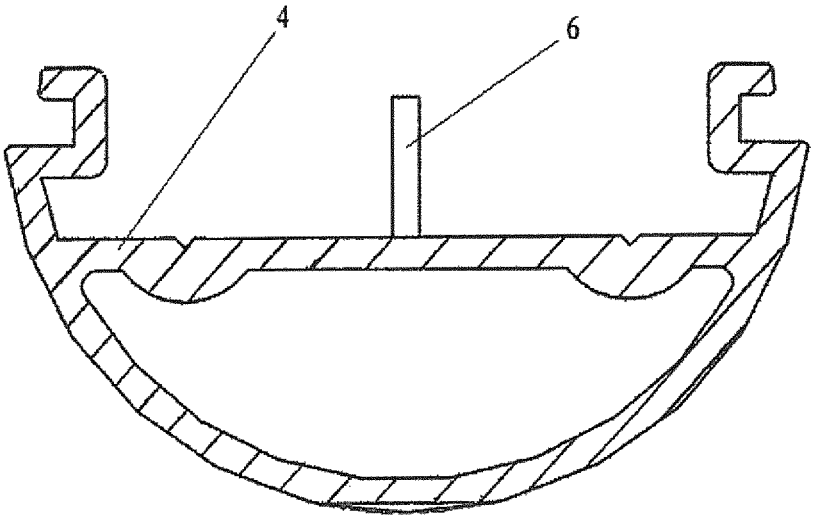
FIG. 5 is a view showing a rivet formed with the heat sink into one piece in another embodiment of the present disclosure.

In another embodiment of the present disclosure, the rivet 6 can be integrated with the heat sink 4 and formed with the heat sink 4 into one piece, as shown in FIG. 5. This can further improve the producing efficiency of the LED lighting device.

In the new design of the present disclosure, the printed circuit board can be fixed on the heat sink by an insulated rivet and the perfect heat transmission is realized between the circuit board and the heat sink by providing the heat conducting member, for example, a heat conducting space washer, and/or the heat conducting medium, for example, a heat conducting silicon therebetween. Meanwhile, more consideration relating to the electrical insulation of the rivet during the design and manufacture of the printed circuit board is avoided. Therefore, the routing design structure of the printed circuit board is improved, and the producing efficiency of the LED lighting device is increased. The use of rivets of plastics can also ensure the printed circuit board and the LED aluminum based board contacting the heat sink firmly and securely and can make it easier to assemble the parts of the LED lighting device. Additionally, the construction of the present disclosure can not only be used in LED lighting devices, but also can be used in other lighting devices, such as a prefocus lamp.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A LED lighting device comprising:

a LED lighting source, a printed circuit board, a heat sink, and a transparent cover, the LED lighting source being provided on the printed circuit board, the transparent cover being attached to the heat sink for protecting the LED lighting source and the printed circuit board; wherein the transparent cover contacts the heat sink; and wherein the LED lighting device further comprises a rivet made of plastic, which fixes the printed circuit board to the heat sink.

2. The LED lighting device according to claim 1, wherein a plurality of the rivets are formed into one piece, which is integrally provided on the heat sink in the process of manufacturing the LED lighting device.

3. The LED lighting device according to claim 1, wherein the rivet is formed integrally with the heat sink.

4. The LED lighting device according to claim 1, wherein a free end of the rivet is in one of the shapes in the group comprising a cone, cylinder and semisphere.

5. A method for manufacturing a LED lighting device, the method comprising:

providing a heat sink for the LED lighting device and a rivet made of plastics;

inserting the rivet from the bottom of the heat sink into a mounting hole of the heat sink;

providing a printed circuit board, and arranging it on the heat sink by bringing the rivet to pass through the printed circuit board;

hot melting a free end of the rivet to fix the printed circuit board on the heat sink; and attaching a transparent cover to the heat sink; and wherein the transparent cover contacts the heat sink.

6. The method for manufacturing a LED lighting device according to claim 5, wherein a plurality of the rivets are formed into one piece, which is integrally provided on the heat sink in the process of manufacturing the LED lighting device.

7. The method for manufacturing a LED lighting device according to claim 5, wherein the rivet is formed integrally with the heat sink.

8. The method for manufacturing a LED lighting device according to claim 5, wherein the free end of the rivet is in one of the shapes in the group comprising a cone, cylinder and semisphere.

* * * * *